United States Patent [19]

Mosburger

[11] 4,313,600

[45] Feb. 2, 1982

[54] SHEET STACKING METHOD AND APPARATUS

[75] Inventor: Hans Mosburger, Weiherhammer, Fed. Rep. of Germany

[73] Assignee: BHS-Bayerische Berg- Hutten- und Salzwerke Aktiengesellschaft, Munich, Fed. Rep. of Germany

[21] Appl. No.: 99,701

[22] Filed: Dec. 3, 1979

[30] Foreign Application Priority Data

Dec. 5, 1978 [DE] Fed. Rep. of Germany ..... 2852603

[51] Int. Cl.[3] ..... B65H 5/34

[52] U.S. Cl. ..... 271/203; 271/256; 271/270

[58] Field of Search ..... 271/270, 151, 256, 275, 271/202, 203, 258, 259

[56] References Cited

U.S. PATENT DOCUMENTS

| | | | |
|---|---|---|---|
| 3,149,834 | 9/1964 | Faeber | 271/275 X |
| 3,834,288 | 9/1974 | Behrens | 271/275 X |
| 4,049,258 | 9/1977 | Zeblisky | 271/151 |
| 4,049,260 | 9/1977 | Szymborski | 271/151 |

*Primary Examiner*—Richard A. Schacher

*Attorney, Agent, or Firm*—Silverman, Cass & Singer, Ltd.

[57] ABSTRACT

A sheet stacking method and apparatus having conveyor belts for feeding overlapping cut sheets of cardboard in a flow to a stacking station, in which in order to form a gap in the flow a second conveyor belt is driven faster than a first conveyor belt and, during the time the second belt is driven at the faster rate, a third conveyor belt lifts the sheets off the second belt and drives them at the same speed as the first conveyor belt until the sheet downstream of the gap has left the second belt, whereupon the second belt is again driven at the same speed as the first belt and the third belt replaces the flow of sheets onto the second belt.

9 Claims, 3 Drawing Figures

SHEET STACKING METHOD AND APPARATUS

BACKGROUND OF THE INVENTION

1. Field of the Invention

The invention relates in general to a method for stacking cut cardboard pieces, and to an apparatus for carrying out this method.

In a corrugated cardboard plant, an automatic delivery system has the task of stacking, for example on a vertically movable table, sheets of corrugated cardboard which have been cut to a specific format. Transport from the transverse cutter to the stacking device is effected by conveyor belts on which the sheets lie overlapping one another in the manner of scales. This overlap is effected due to the fact that the conveyor belts run more slowly than the arriving cardboard web.

The stack changing is effected in that the completed stack is driven out laterally and then the stacking device, for example the vertically movable table, is repositioned afresh. Since stack changing should take place without the speed of production of the plant being reduced, a gap must be formed within the flow of overlapping sheets in order to make the necessary time for the stack change.

2. Description of the Prior Art

It is already known for this purpose to block up the arriving flow of corrugated cardboard sheets. Blocking up can be effected by a blocking flap which is hinged down from above, or by a stop bar which is raised between two conveyor belts. Moreover it is possible to stop one of the belts while the subsequent belts continue to run with unchanged speed. The gap in the flow of overlapping sheets is produced by the speed difference of two successive belt lengths.

All the known possibilities have the disadvantage that irregular overlapping of the sheets occurs due to blocking up. As a result of different friction conditions, following sheets are pushed one over the other; this has the consequence that troubles arise in stack formation. During blocking up, lateral deviation of individual sheets can occur, which does not render possible clean stack formation. If several stacks are being formed side by side at the same time a mutual intermeshing of the stacks occurs which makes the separation of the stacks difficult and involves considerable interference with the progress of the work.

SUMMARY OF THE INVENTION

The invention is based upon the problem of rendering possible a constantly regular scale-type overlapping of the sheets and an exact stack formation.

The invention brings the advantage that despite the provision of the necessary gaps in the flow of sheets, the scale-type overlap position remains substantially the same, deviation of the sheets in the overlapping flow to the side is avoided, and shifting of the sheets in their longitudinal direction in relation to one another can be suppressed, so that satisfactory stacking of the sheets can be achieved with exact stack corners.

Figure 1:
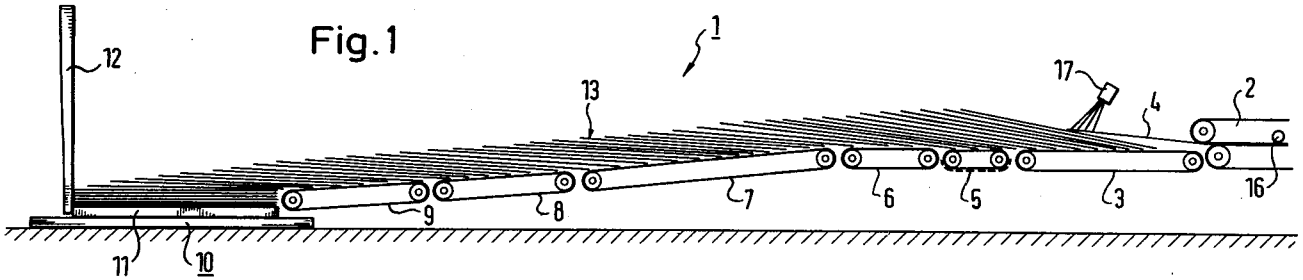
FIG. 1 shows a diagrammatic lateral elevation of a stacking apparatus for cut corrugated cardboard sheets with a continuous, scale-type overlapped flow of sheets filling the stack container.

The stacking apparatus 1 comprises a conveyor device 2 in the form of two endless conveyor belts arranged one above the other, coming from a sheet-cutting apparatus (not shown). This conveyor device 2 is adjoined by an endless conveyor belt 3. The sheets 4 come freely in close order from the conveyor device 2 out on to the endless conveyor belt 3.

The conveyor belt 3 is adjoined by a separating station 5 and this by the continuing conveyor belts 6, 7, 8 and 9.

The sheets 4 are deposited by the conveyor belt 9 in a stacking station 10. This stacking station can consist of a vertically movable table or a stationary table, and in either case the stacking table plate 11 can be driven out of the stacking station transversely of the direction of conveying of the sheets 4.

The sheet stop 12 is adjustable, in a manner not illustrated, to the sheet length.

The overlapping sheet flow 13 forms due to the fact that the speed of the conveyor belts is lower than that of the conveyor device 2. A conveying flow overlapping in scale manner is desired because this stacking of the sheets 4 in the stacking station takes place more favourably, although with lower feed speed.

The emptying of the stacking station 10 is effected by lateral driving out of the stacking table plate 11 with the sheet stack situated on it, in which operation the working rate of the entire installation should not be reduced. For this purpose it is necessary that the sheet flow 13 should be interrupted during the time of emptying of the stacking station. Such an interruption of the sheet flow 13 can be seen from FIG. 2.

Figure 2:
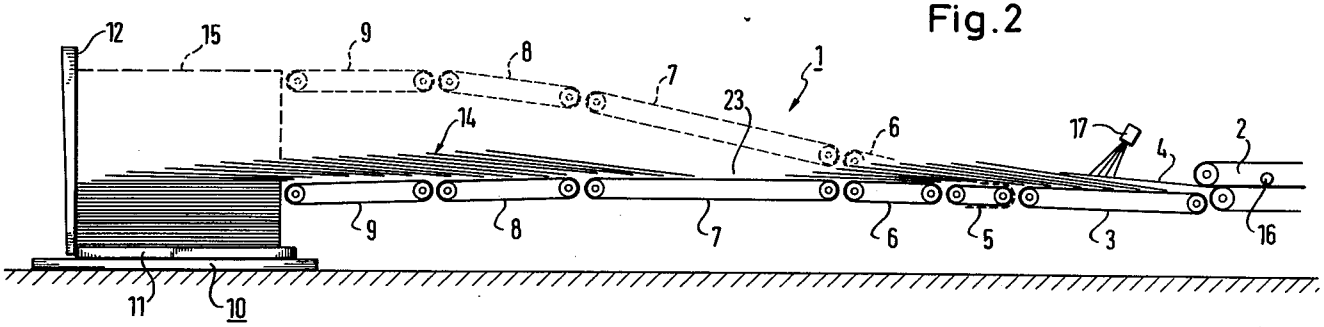
FIG. 2 shows a diagrammatic view, as in FIG. 1, but with overlapping sheet flow already interrupted.
Figure 3:
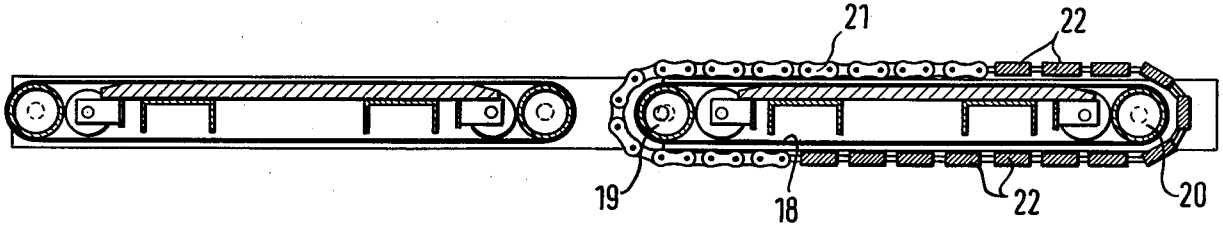
FIG. 3 shows a diagrammatic lateral elevation, partly in section, of the sheet-separating station.

The interruption becomes necessary in the flow of sheets when the sheet flow part 14 arriving at the stacking station produces the desired stack height 15, as indicated in chain lines in FIG. 2. In order that the stack height may be maintained exactly, in the region of the conveyor device 2 there is provided a device 16 which counts the individual sheets following one another. A pre-determined number of sheets is set in advance on this sheet-counting device 16. After this pre-set number of sheets is reached, the sheet-counting device delivers a switch signal for the separating station 5 and for the drives of the conveyor belts 6 to 9 following this station. The speed of the conveyor belts 6 to 9 is increased in comparison with the original speed. The speed of the conveyor device 2 and of the conveyor belt 3 is not changed.

To brake the sheets 4 issuing from the conveyor device 2 there serves a retaining device 17 known per se, for example in the form of a vertically movable elastic brush.

The separating station 5 consists of an endless conveyor belt 18 which is always driven at the same speed as the conveyor belts 6 to 9. The conveyor belt 18 is guided round reversing rolls 19, 20, one of which is drivable. Coaxially with these reversing rolls 19, 20 there are arranged chain wheels (not shown) over which an endless chain 21 runs, one run length of which carries louver strips 22. The drive for the chain 21 with louver strips 22 is triggered by the signal given by the sheet-counting device, and drives the chain 21 at a speed which corresponds to the speed of the endless conveyor belt 3. The first louver strip 22 coming into the upper run section and the following strips lift the pertinent sheets off of the belt 18 and thus render it possible for the conveyor belt 18 and also the subsequent conveyor belts 6 to 9, the drives of which have been stepped up to higher speed by the sheet-counting device, to clear away the sheets exactly. Due to the face that the conveyor belts 6 to 9 and 18 run at increased speed, the gap 23 indicated in FIG. 2 occurs in the sheet flow 13.

The length of the louver section, the speeds of the conveyor belts 6 to 9 and 18 in relation to the speed of the louver strips 22 and the lengths of the conveyor belts 6 to 9 must be adapted to the necessary emptying time of the stacking station 10.

The speeds of the conveyor belts 6 to 9 and 18 are successively switched back again to the original slower speed when the last sheet of the flow part 14 leaves the respective belt. Switch sensors or the like necessary for this purpose are not illustrated.

It is also possible to effect the path length control by appropriate control means, such as path length pulse emitters or the like.

As may be seen from FIG. 2, with increasing stack height the conveyor belt sequence 6, 7, 8 and 9 can be automatically adjusted in height accordingly. However when a vertically movable table is used it is also possible to leave the height of the conveyor belts unchanged and to lower the table gradually.

I claim

1. In a method for the stacking of sheets in which a flow of sheets overlapping like scales is fed by a removal conveyor belt from a sheet feed conveyor belt to a stacking station, the invention comprising the steps of:

increasing the speed of the removal conveyor belt relative to the feed conveyor belt to form a gap in the flow of sheets; and lifting a portion of the sheet flow upstream of the gap away from the removal conveyor belt by advancing a lifting belt having louver strips to interpose the louver strips between the removal conveyor belt and said portion of the sheet flow upstream of the gap and the lifting belt conveying said portion at the same speed as the feed conveyor belt.

2. The method according to claim 1, including the step of again driving the removal conveyor belt at the same speed as the feed conveyor belt as soon as the portion of the sheet flow downstream of the gap has left the removal conveyor belt.

3. The method according to claim 1, including the step of counting the sheets upstream of the removal conveyor belt forming said gap after a pre-selectable stack sheet number is reached.

4. In a sheet stacking apparatus comprising a stacking station, and sheet feed and removal conveyor belts for feeding sheets to the stacking station, the invention comprising:

means for driving the removal belt faster than the feed belt to form a gap in said flow; and means for lifting a portion of the sheet flow upstream of the gap away from the removal belt including a lifting belt having louver strips interposable between the removal conveyor belt and said portion of the sheet flow upstream of the gap and for conveying said portion at the same speed as the feed belt.

5. Apparatus according to claim 4, in which the lifting means comprises an endless conveyor adjacent the removal belt, the endless conveyor comprising transverse strips and being drivable independently of the feeding belt.

6. The apparatus according to claim 4, in which there is provided a sheet-counting device which controls the conveyor belts.

7. The method according to claim 1, including advancing the lifting belt so that the louver strips are free of said portion of the sheet flow upstream of the gap.

8. The apparatus according to claim 4 in which the lifting belt is an endless conveyor belt adjacent the removal belt which is drivable independent of the sheet feed conveyor belt and the louver strips comprising strips arranged transverse of the removal belt.

9. The apparatus according to claim 4 in which said louvers form only a portion of the lifting belt so that as the lifting belt is advanced, the louver strips are alternately interposed between the removal belt and said upstream portion and free thereof.

* * * * *